US005996216A

United States Patent [19]

Varga

[11] Patent Number: 5,996,216

[45] Date of Patent: Dec. 7, 1999

[54] APPARATUS FOR APPLYING SOFT FILAMENTS TO CONTINUOUS ELONGATE ARTICLES

[75] Inventor: Joseph Varga, Woodbridge, Canada

[73] Assignee: Nextrom, Ltd., Concord, Canada

[21] Appl. No.: 09/109,675

[22] Filed: Jul. 2, 1998

[51] Int. Cl.[6] ..... B23P 21/00

[52] U.S. Cl. ..... 29/714; 57/13; 57/14; 242/131

[58] Field of Search ..... 29/714, 709; 28/299; 57/3, 13, 14, 314, 10, 15, 16; 442/59; 242/131, 129.12, 171, 150 R

[56] References Cited

U.S. PATENT DOCUMENTS 3,667,203 6/1972 Koschatzky et al. .

*Primary Examiner*—P. W. Echols
*Assistant Examiner*—John C. Hong
*Attorney, Agent, or Firm*—Lackenbach Siegel Marzullo Aronson & Greenspan, P.C.

[57] ABSTRACT

A filament applicator includes a frame which defines a machine axis through which an elongate element may be guided at an application station at which filaments are to be applied to or introduce into the elongate element, such as an optical cable. A plurality of chambers are provided, each of which defines a chamber axis substantially parallel to the machine axis and mounted on the frame for rotation about the machine axis. Each chamber is substantially closed and has a panel at an axial end of the chamber which is movable between an open position for inserting and removing a wound package of filament material within the chamber and closed position for substantially sealing the chamber and preventing air turbulence within the chamber upon rotation about the machine axis. Each panel has an opening therein through which the filament material can be removed from the wound package. Each filament is guided from an associated opening in a door or panel of a chamber to the machine axis for winding about or introduction into the elongate element. By sealing the chambers during operation, the applicator speed can be significantly increased, above 500 rpm, while maintaining control over the relatively flimsy, lightweight and soft filaments, such as synthetic KEVLAR fibers.

21 Claims, 7 Drawing Sheets

APPARATUS FOR APPLYING SOFT FILAMENTS TO CONTINUOUS ELONGATE ARTICLES

BACKGROUND OF THE INVENTION

1. Field of the Invention

The invention generally relates to machinery for manufacturing cables and other conductors and, more specifically, to an apparatus for applying soft filaments to continuous elongate articles.

2. Description of the Prior Art

In the manufacture of conductors and cables it is frequently necessary to apply elongate filaments to one or more continuous elongate elements. For example, in the manufacture of optical cables, a bundle of optical fibers are frequently moved through an application station at which a plurality of filaments are typically applied to or introduced into the bundle prior to being brought to an extrusion station at which an outer plastic covering or jacket is applied to encapsulate and shield the optical fibers. The elongate filaments that are introduced may be, for example, a bundle of very soft and flexible strands or fibers. Such filaments, while very soft and flexible, are extremely strong in tension and may be used, with or without additional rigid cores, in order to eliminate or minimize tension and, therefore, stretching of the optical fibers, the optical and electrical properties of which are very sensitive to tension. One of the problems that has been encountered is efficiently applying or introducing such Kevlar filaments into the cable. One specific example of such an optical cable has a "tight coated" construction, in which a plastic buffer is extruded directly onto the coated fibers to form a buffered fiber. While there are many different variations of such cable design, in a simplex structure, one or two light buffered fibers are surrounded with aramid yarn strength members and with a plastic jacket. However, one of the problems with introducing the aramid yarn filaments into the cable has been the difficulty of controlling and handling the filaments, particularly under higher speed conditions. Such filaments are typically very soft, flexible, lightweight and flimsy. Once unwound from a cop, a cylindrical or conical mass of such filamentary material wound on a quill or tube, the removed filament is very much subject to the forces that manifest themselves in such machine, including gravity, centrifugal force, and air turbulence. When the optical fibers are passed along the machine axis at the application station and the wound packages of filamentary materials are rotated about the machine axis and about the cable into which the filament is to be introduced, it has been found that above relatively low threshold rotational speeds it becomes very difficult, if not impossible, to control the filamentary material of the type under discussion, particularly the softer and flimsier forms of such filaments. Depending on the nature of the filamentary materials used, such threshold rotational speeds can be in the range of 100–150 rpm. At higher speeds, any such filamentary materials which fly off the wound packages or cops are extremely difficult to control and turbulence makes it very difficult to control the filaments, in some cases causing the filament to engage and snag the machine parts, become twisted and possibly even knotted, rendering the filament difficult to use and subject to damage. Such difficulties may necessitate the stopping of the applicator, resulting in down time and unnecessary loss of efficiency of operation.

SUMMARY OF THE INVENTION

In order to overcome the problems inherent in prior art applicators, it is an object of the present invention to provide a filament applicator which does not have the problems inherent in prior art applicators.

It is another object of the present invention to provide a filament applicator which is simple in construction and economical to manufacture.

It is still another object of the present invention to provide a filament applicator as in the previous objects which is suitable for use with filaments that are extremely soft and flexible and light in weight, without being unduly subjected to the effects of wind turbulence.

It is yet another object of the present invention to provide a filament applicator of the type under discussion which may be used to apply soft, flexible and lightweight filaments at much higher speeds than can be achieved with existing filament applicators.

It is a further object of the present invention to provide a filament applicator as in the previous objects which can be used to introduce a wide range of filaments from very soft and flexible filaments to filaments that are moderately soft and flexible.

In order to achieve the above objects, as well as others which will become apparent hereafter, a filament applicator in accordance with the present invention for applying a plurality of filaments about a continuous elongate element at an application station comprises a frame defining a machine axis at said application station. First guide means is provided for guiding the elongate element along said machine axis at said application station. A plurality of chambers are provided, each defining a chamber axis substantially parallel to said machine axis and mounted on said frame for rotation about said machine axis. Each chamber is substantially closed and has a panel at an axial end of said chamber movable between an open position for inserting or removing a wound package of filament material from within the chamber and a closed position for substantially sealing said chamber and preventing air turbulence within said chamber upon rotation about said machine axis. Each said panel has an opening therein through which a filament of a package within an associate chamber can be removed from said chamber. Second guide means is provided for guiding each filament from an associated opening to said machine axis for winding about or introduction into the elongate element, whereby removal of a filament from its associated wound package within a chamber is not influenced by air turbulence as said chambers containing the wound packages of filaments rotate about the machine axis.

BRIEF DESCRIPTION OF THE DRAWINGS

These and other objects, features and characteristics of the present invention will be more fully apparent, understood and appreciated from the ensuing detailed description, when read with reference to the various figures of the accompanying drawings, wherein.

DESCRIPTION OF A PREFERRED EMBODIMENT

Figure 1:
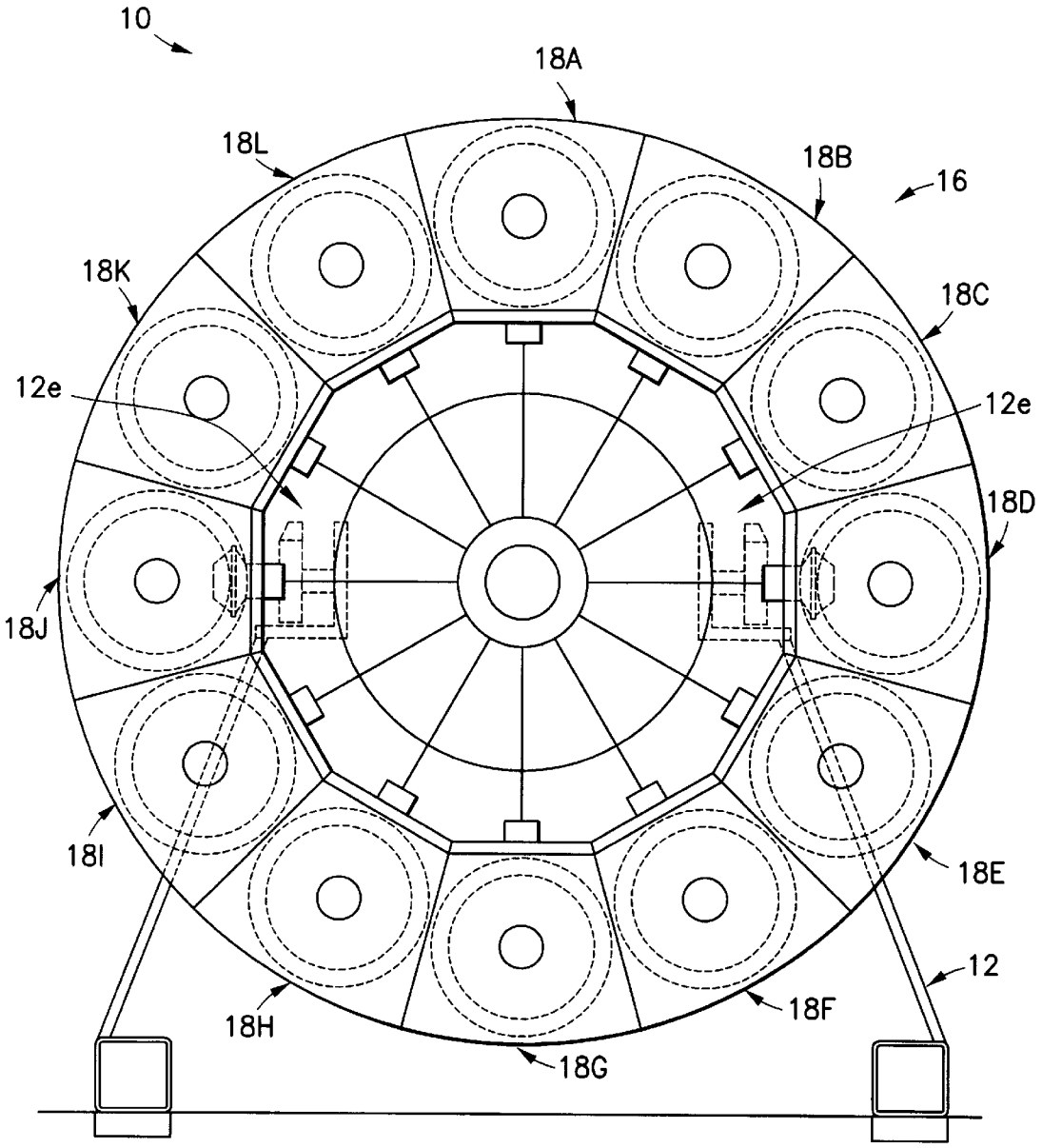
FIG. 1 is a front elevational view of a filament applicator in accordance with the present invention, showing twelve chambers for receiving wound packages of filament material arranged for rotation about a machine axis along which a cable or conductor is moved for application of the filaments.

Referring now specifically to the figures, in which identical or similar parts are designated by the same reference numerals throughout, the apparatus for applying generally soft filaments to continuous elongate articles, shown in FIG. 1, is generally designated by the reference numeral 10.

The apparatus 10 includes a support frame 12 which is positioned at an application station of a cable production line. As will be evident to those skilled in the art, the filament applicator of the present invention will be suitable for use for the production of numerous types of cables, such as fiberoptic cables or other cables that require the introduction of one or more soft, flexible and/or flimsy fiber filaments, such as synthetic fibers for generalized use in the industrial arts, sometimes marketed under the brand name KEVLAR. The discussion that follows will be in relation to a specific application of the invention in connection with the manufacture of tight coated fiberoptic cable FC (FIG. 2), although, as suggested, the applicator may be used in the manufacture of any continuous elongate element or article.

The frame 12 defines a machine axis $A_m$ (FIG. 2) at the application station at which the apparatus 10 is positioned or located. The apparatus 10 includes an axial through opening or channel 14 which is generally coextensive with the machine axis $A_m$ through which the elongate element FC may be guided along the machine axis while the cable or conductor is fed through the application station.

Figure 2:
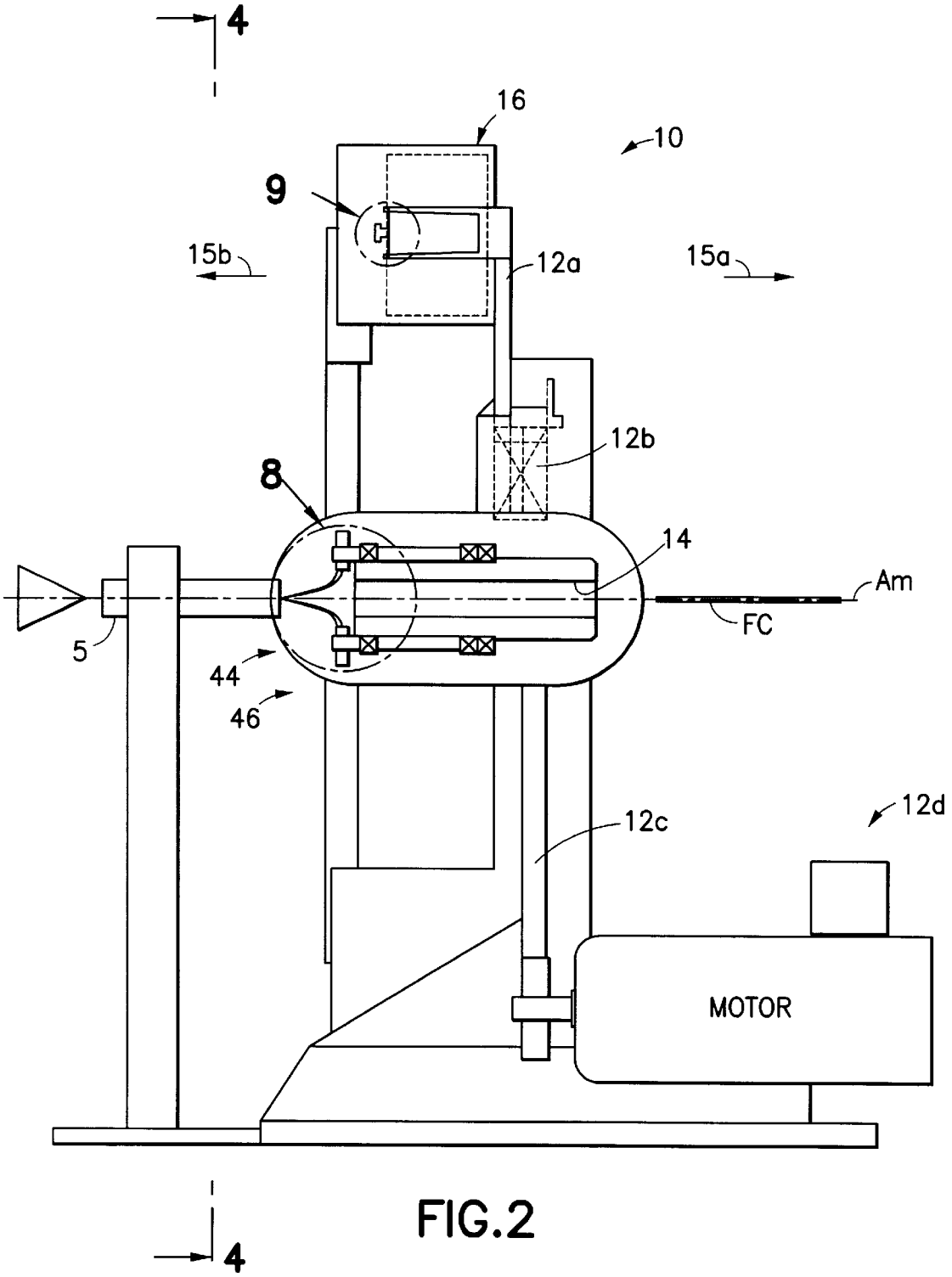
FIG. 2 is a side elevational view of an applicator similar to the one shown in FIG. 1.

Referring primarily to FIGS. 1 and 2, there is provided a cylindrical drum or housing 16 which is mounted on mounting plate 12*a* (FIG. 2) for rotation about the machine axis $A_m$. The mounting plate 12*a* is selectively coupled to gearing 12*b* which is coupled, by means of belt 12*c*, to a drive motor 12*d*. By actuating the motor 12*d*, therefore, the described drive train can rotate the cylindrical drum 16 about the machine axis $A_m$. Suitable controls (not shown) are provided for selectively controlling the rotation of the cylindrical drum 16 and for braking the drum by means of brakes 12*e* (FIG. 1) which may engage a brake disc mounted for rotation with the rotating assembly. The details of the rotating assembly, the drive and the braking mechanism, as well as the control elements for regulating the operation of rotation of the applicator are not critical for the purposes of the present invention, and are not disclosed or described in detail since any conventional means well known in the art may be used for this used.

As best shown in FIG. 1, there are provided a plurality of chambers 18A–18L along the periphery of the cylindrical drum 16, twelve such chambers being illustrated. However, it will be clear that the apparatus may be provided with any desired number of chambers and that any desired number of chambers of the ones that are provided may be used for any given application.

Figure 3:
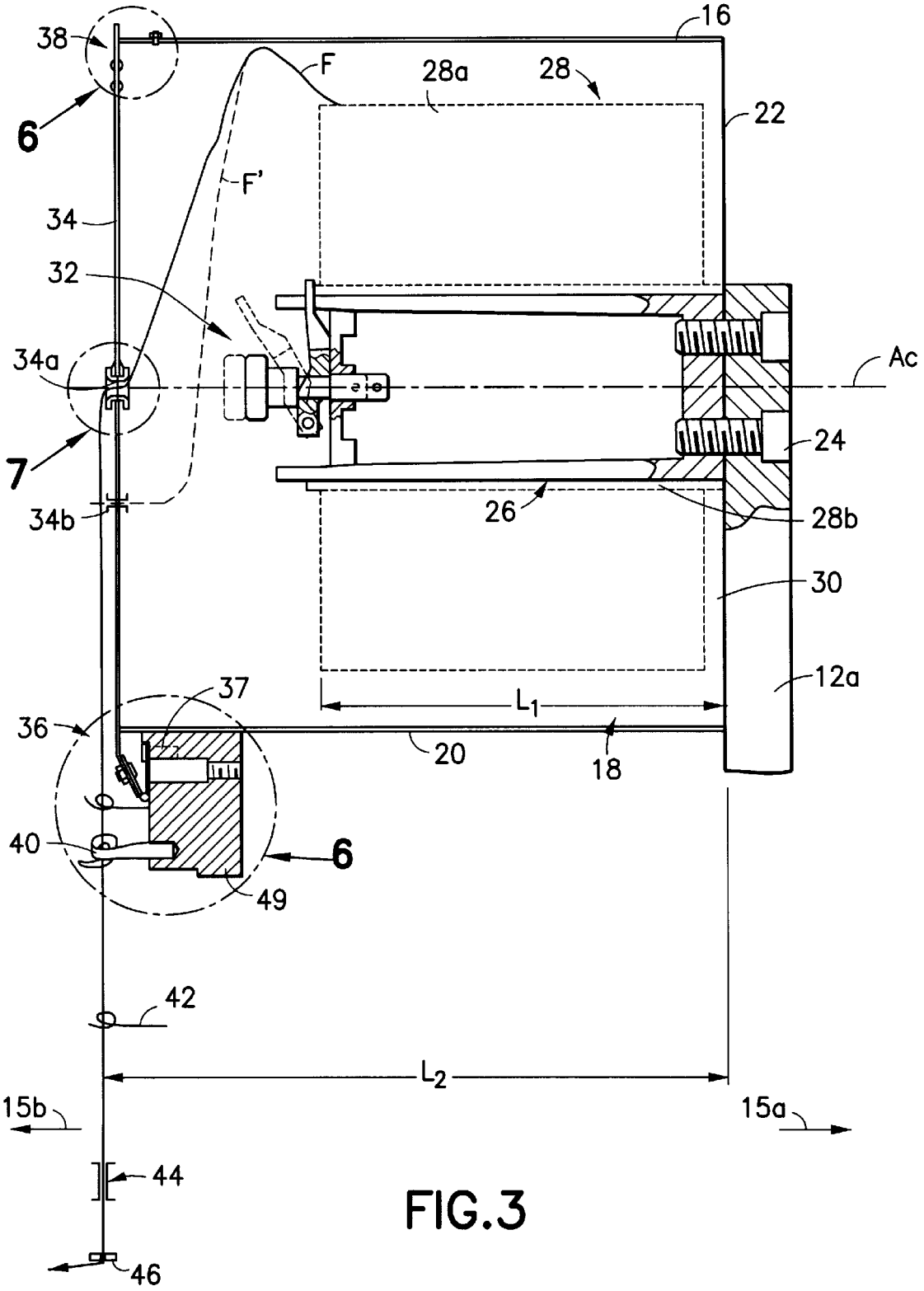
FIG. 3 is an enlarged side elevational view, in partial cross section, of one of the chambers of the applicator, as taken along line 3—3 in FIG. 4, showing the details for securing a wound package of filamentary material within the chamber and the details of the closure panel for preventing air turbulence within the chamber during rotation about the machine axis.

Referring primarily to FIG. 3, the upper chamber 18*a* is illustrated as including a generally cylindrical wall 20 defining a generally horizontal axis $A_c$, which is parallel to the machine axis $A_m$. It will be clear that as the chamber 18 rotates about the machine axis $A_m$, the chamber axis $A_c$ will remain parallel to the machine axis. While the details of a chamber 18 will be described, it will be clear that the same description applies equally to all the chambers 18A–18L.

The cylindrical wall 20 is suitably secured to the mounting plate 12 and/or the outer cylindrical drum or housing 16. In FIG. 3 the chamber 18 is shown provided with a rear, upstream wall 22 which closes that axial end of the chamber 18 that faces the upstream end 15*a* of the line, so that the upstream end of the chamber 18 is, for practical purposes, permanently closed. Since no access is required through the upstream end of the chamber 18, that end may be used for attachment to the mounting plate 12*a*, such as by means of bolts 24.

The bolts 24 may also be used to secure a generally horizontal hollow shaft 26 within the chamber 18 which has an axial length $L_1$, along the axis $A_c$, which is smaller than the axial dimension $L_2$ of the cylindrical wall 20. The shaft 26 has an outer diameter selected to slidably support a cop or a wound filament package 28 which includes the wound filament package 28*a* wound on a hollow, usually cardboard tube 28*b*. In FIG. 3 the tube 28*b* is shown in phantom outline in a position it would normally assume during operation of the applicator.

The rear wall 22 is preferably provided, on the surface facing the inside the chamber 18, with a layer of soft, conforming material 30, which, in use, abuts against the upstream surface 28*c* of the cop 28 in order to conform to any irregularities in the shape of the cop, at the upstream axial end thereof, to fill in any irregular spaces to thereby prevent a filament from inadvertently and undesirably being carried into such spaces by any one of a number of different forces to be described. One objective of the applicator is to unwind the wound filament package 28 and withdraw or extract a filament F from the chamber 18 in an orderly manner while preventing the filament from engaging and/or snagging against any machine parts, becoming entangled or knotted with itself, and ensure that the filament F is withdrawn at a substantially low tension with no damage to itself. In the presently preferred embodiment, the conforming layer or seal 30 is in the nature of an annular disk made of a relatively soft plastic foam material which is adhered to the rear wall 22 in any suitable or conventional manner. Therefore, even when the cop 28 is removed from the chamber 18*a*, the conforming layer 30 remains in place for abutment against the next subsequent cop to be used.

In order to secure the tube 28*b* and the wound filament 28*a* in place on the shaft 26 during operation of the applicator, there is provided a locking mechanism 32 which preferably makes it easy and convenient to mount the package 28 on and remove the empty tube 28*b* from the shaft 26, while ensuring that during operation the package remains fixed in place, as suggested in dashed outline in FIG. 3. The details of the lock 32 will be more fully described in connection with FIG. 9.

An important feature of the present invention is the provision of a door, cover or panel 34 which can be selectively opened to provide access to the chamber 18, at the downstream axial end thereof, for insertion and removal of the wound packages 28, and closed to substantially seal the chamber, with the exception of a relatively small opening 34*a* within the door or panel 34 through which the filament F may be removed from the chamber during operation. In FIG. 3 the opening is shown as a eyelet 34*a* mounted substantially along the chamber axis $A_c$. The door or panel 34 may be provided with an additional eyelet or opening 34*b* somewhat closer to the machine axis, for reasons to be described. The door panel 34 is also attached to the machine by suitable means to allow such selective opening and closing of the panel. In the embodiment illustrated, such means is in the form of a hinge 36 attached to a rotating component by a suitable fastener, such as bolt 37. Additional details of the hinge 36 will be more fully discussed in connection with FIG. 5.

As best shown in FIG. 3, once the filament is removed from the cop or wound package 28, it is directed to the eyelet 34*a* in the panel or door 34, and subsequently guided to the point of application. The specific guide elements used for this purpose are not critical. However, in the embodiment illustrated, such guides include a pigtail retainer element 40 mounted on a rotating component associated with the cylindrical drum 16. A plurality of such guides may be provided, as needed, FIG. 3 illustrating a further pigtail retainer element 42 spaced between the first pigtail retainer element 40 and the machine axis $A_m$. These guides are intended to advance the filament F from each of the associated chambers 18A–18L to the region of the machine axis, where the fiber cable FC passes so that the filaments F may be applied or introduced into the cable. There is also preferably provided, along the path of the fiber F, prior to reaching the machine axis, a suitable tension adjusting mechanism 44 and tension sensor 46 so that the tension on the fiber F may be monitored and adjusted as necessary in order to maintain the tension of all the fibers being applied or introduced into the cable at substantially the same tension. Once the fiber F has been adjusted to the proper tension it advanced to the closing station where the fibers are collectively applied or introduced into the advancing cable.

Figure 4:
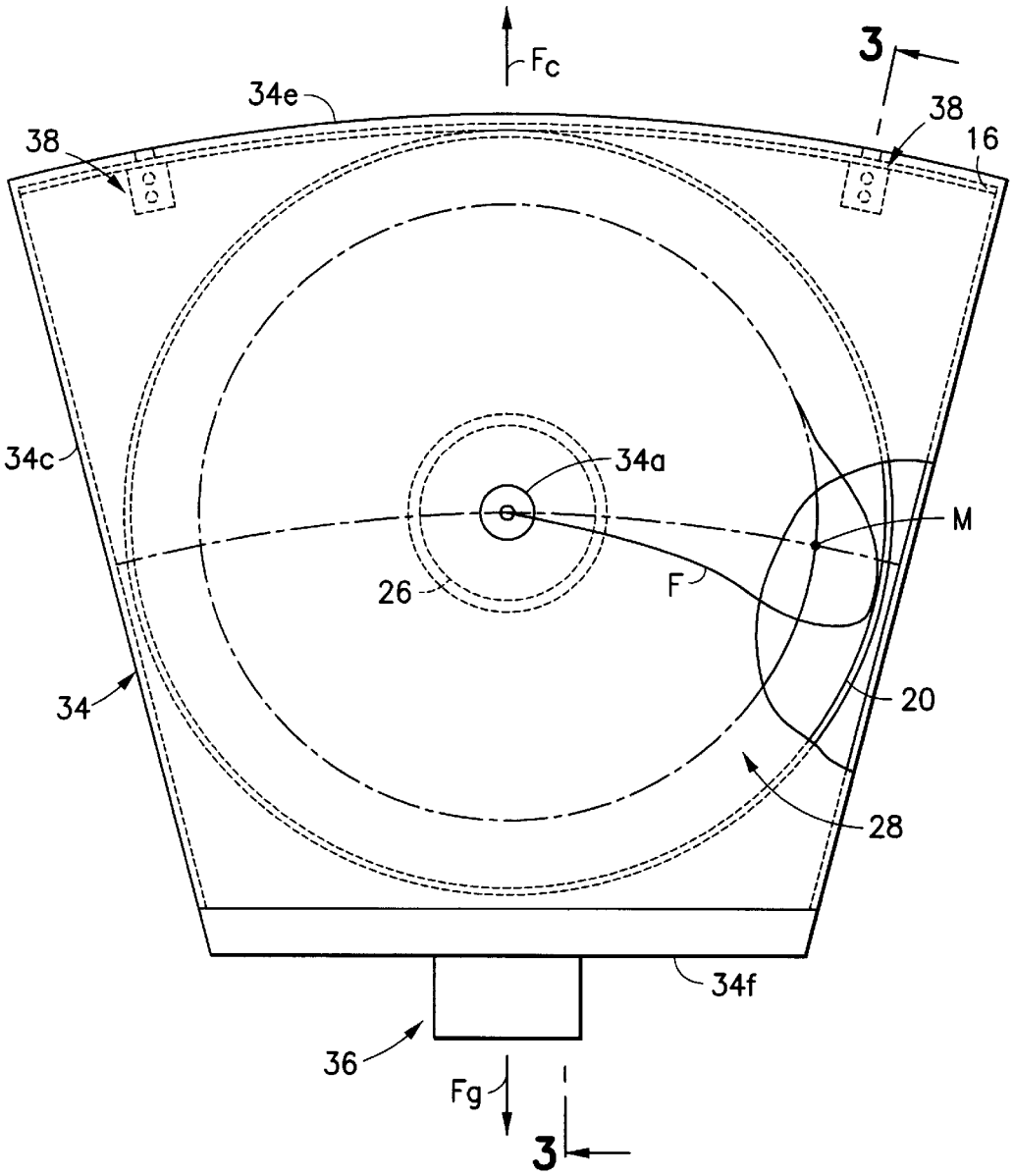
FIG. 4 is an enlarged front elevational view of one of the closure panels used to cover the access opening of a chamber through which the wound package of filament material may be inserted and removed.

Referring to FIGS. 1 and 4, it will be evident that one mechanically efficient configuration of the door or panel 34 is to shape it in the general form of a trapezoid, which permits the placement of a door or panel 34 for each of the chambers 18A–18L while creating a substantially continuously surface when all the doors or panels are closed with no spaces between the door panels which might introduce unnecessary turbulence during high speed rotation of the drum 16. With this configuration, the door or panel 34 has opposing straight edges 34*c*, 34*d* which are coextensive with radial lines passing through the machine axis $A_m$. The radially outermost edge of the door or cover 34 is arcuate edge 34*e* which is in the form of an arc generally coextensive with the circumference of the cylindrical drum 16. At the radially innermost point, the door or panel 34 is provided with a substantially straight edge 34*f* which is normal to the radial direction. It is along the lower edge 34*f* that the doors or panels 34 are preferably hinged. It will be clear that during high speed rotation of the drum 16 radially outwardly acting centrifugal forces will tend to move all rotating bodies radially outwardly. By placing the hinge assembly 36 along the inside edge 34*f*, the door or panel 34 will not inadvertently open but will, in fact, be subjected to forces which tend to force the door or panel 34 to close and enhance the seal formed between the door or panel and the cylindrical wall 20. To further ensure that the door or panel remains closed both during operation and when rotation of the cylindrical drum 16 has ceased, there is advantageously provided a latch mechanism 38 (FIGS. 4 and 5), one form of which is illustrated in FIG. 6. However, it will be clear that any suitable or conventional latch or door locking mechanism may be used for this purpose.

Figure 5:
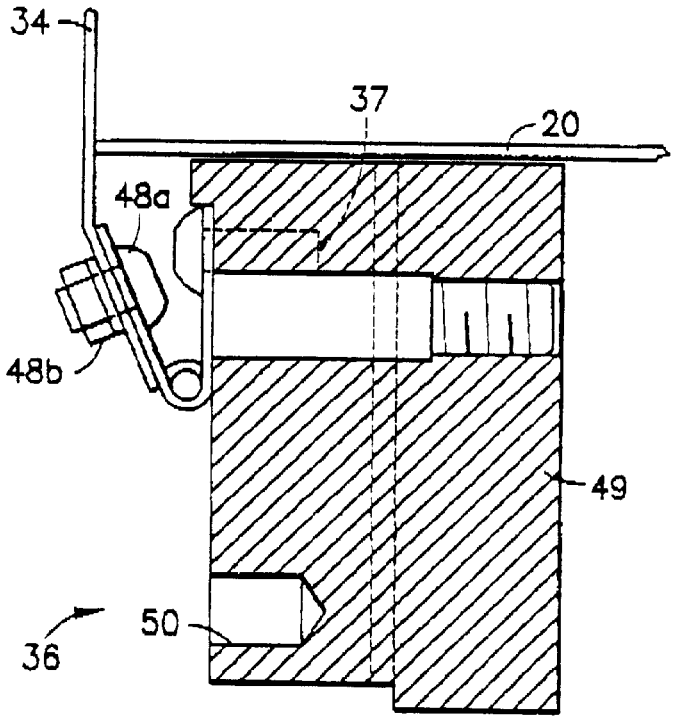
FIG. 5 is an enlarged detail of section 5 in FIG. 3.
Figure 6:
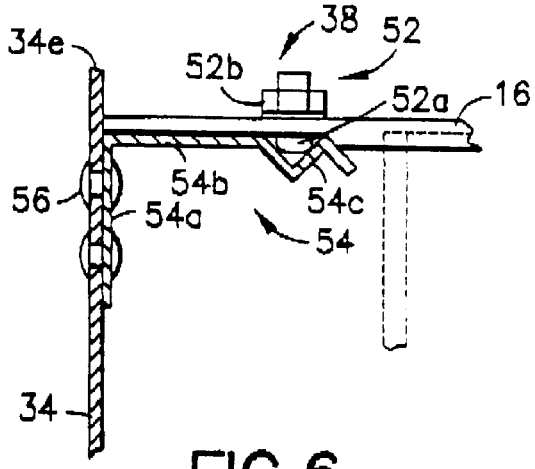
FIG. 6 is an enlarged detail of section 6 in FIG. 3.

In FIG. 5, the detail of the hinge mechanism 36 is illustrated, in which one portion of the hinge is securely attached to the rotating member by means of any suitable fastener 37, while the other element of the hinge is secured to the innermost edge 34*f* of the door or plate 34 by any suitable or conventional means. In the embodiment illustrated, the door or panel 34 is secured to the other element of the hinge by means of a further bolt 48*a* and a corresponding nut 48*b*, as shown. The same rotating part 49 that supports or carries the hinge 36 is also preferably provided with a threaded axial hole 50 for receiving a suitable guide element, such as the pigtail retainer guide 40 shown in FIG. 3.

FIG. 6 illustrates one presently preferred embodiment for a latch construction 38, which includes, in this example, a threaded bolt 52*a* which is provided with a tapered or conical shaped head 52*a*, the bolt being secured to the cylindrical drum or housing 16 by means of a corresponding or associated nut 52*b*. Mounted in proximity thereto, a leaf spring 54 is provided which has one portion 54*a* secured to the door or panel 34 by means of rivets 56, while a right angle portion 54*b*, provided with a V-shaped notch 54*c*, is arranged to engage the tapered screw head 54*a* when the door or panel 34 is in its fully closed position as shown in FIG. 6. The leaf spring will, therefore, maintain the door or panel 34 in its closed position, as shown in FIGS. 3 and 6, high speed rotation of the cylindrical drum 16 having the effect of urging the portion 54*b* inwardly into the chamber 18 to thereby maintain the closed position of the door or panel. However, when the machine is at a standstill, the door or panel 34 can be opened by pulling on the upper edge 34*e* of the panel to cause the leaf spring portion 54*b* to deflect downwardly, as viewed in FIG. 6, to clear the tapered head 52*a* which retains the door or panel in place.

Figure 7:
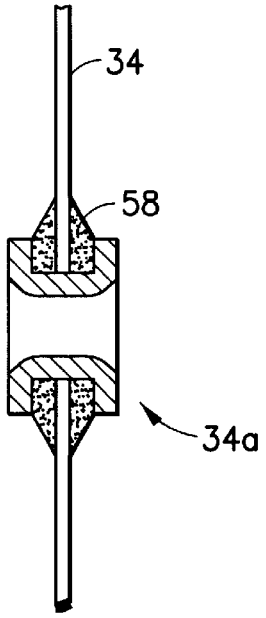
FIG. 7 is an enlarged detail of section 7 in FIG. 3.

In FIG. 7 the detail of the eyelet 34*a* is shown, indicating how the eyelet 34*a* may be mounted through an aperture in the panel 34 with any suitable adhesive 58, such as silicone.

Figure 8:
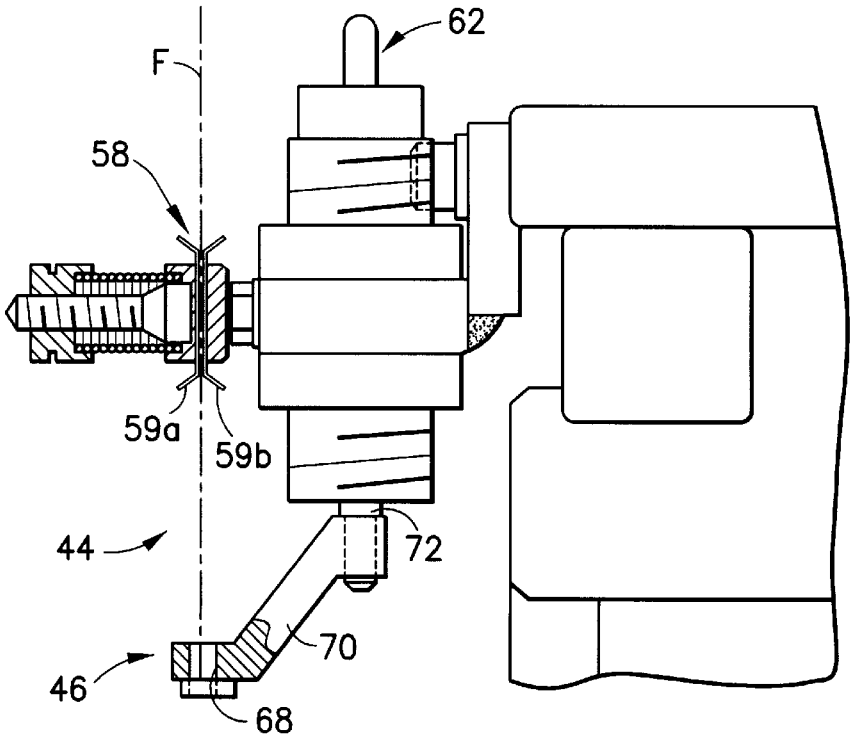
FIG. 8 is an enlarged detail of a tension controller and a tension sensor used in connection with each filament emanating from one of the chambers illustrated in FIG. 1, at section 8 in FIG. 2.

In FIG. 8 some details are illustrated of the tensioning mechanism as well as tension the sensing arrangement for monitoring and adjusting the tension on the filament F. As the filament F is drawn radially inwardly towards the machine axis $A_m$, it is guided through two adjacent plates 59*a*, 59*b* which are spring loaded and arranged to apply a tension to the filament. A conventional manual tensioning arrangement may be used which includes an adjusting knob 60 for modifying the relative pressure applied between the two plates. After extending through the adjacent plates, the filament F extends through an eyelet 68 mounted on an arm 70 supported on a rod 72 which forms part of a tension sensing mechanism of the type known to those skilled in the art. By monitoring the tension of the filament F as it passes through the eyelet 68 the tension between the plates 59*a* and 59*b* can be modified as needed to maintain the tension of the filament F at the outlet of the eyelet 68 to be substantially constant as it is applied to the cable.

Figure 9:
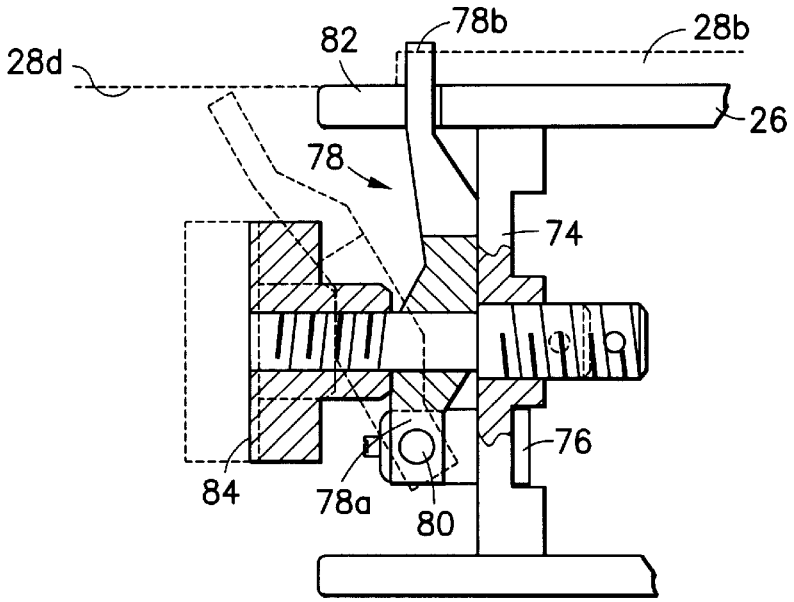
FIG. 9 is an enlarged detail of section 9 in FIG. 2.

In FIG. 9 the details of the lock mechanism 32 are illustrated. As shown, the shaft 26 is provided, in the hollow portion thereof, with a transverse member 74 which is secured to the shaft. There is provided a support member 76 on the transverse member 74, below the chamber axis $A_c$. A movable member 78 is pivotally mounted at one end 78*a* about a pivot pin 80, while the other end 78*b* is in the form of a gripping finger which is movable between an upright position, as shown in solid outline in FIG. 9, for gripping the tube 28*b* of the cop 28, and a releasing position, shown in phantom outline in FIG. 9, in which the gripping finger pivots about the pivot pin 80 to a point where it comes within the inside diameter 28*d* of the tube 28*b*, so that the tube can clear the gripping finger. An adjusting knob 84 is used to adjust the position between the engaging or gripping position and the disengaging or releasing position by turning the knob on a threaded shaft. The arrangement shown is but one example of a mechanism that may be used to secure or lock the position of the wound package on the shaft 26, although it will be evident to those skilled in the art that numerous other locking arrangements may be used for this purpose.

Figure 10:
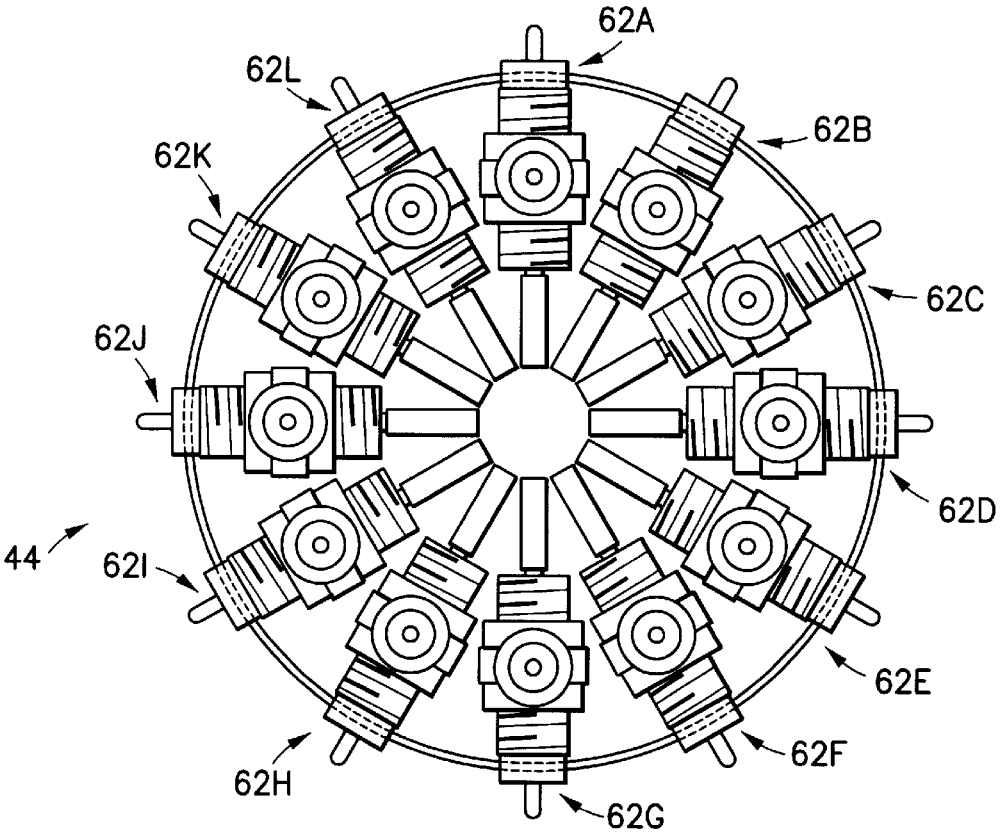
FIG. 10 is a front elevational view of an enlarged detail of the tensioning devices at 8 in FIG. 2.

In FIG. 10 an array of tension adjusting units 62A–62L are shown in an array suitable for controlling the tensions of each of the filaments directed from corresponding or associated chambers in which a wound package or cop 28 is placed.

The operation of the device will now be described. A cop 28 is placed into the desired number of chambers, as may be required, to provide a desired number of filaments to be applied to the cable FC. Thus, if twelve filaments are desired for introduction into any given cable, a cop 28 is placed into each of the twelve chambers 18A–18L. For each cop 28, the free end of the filament F is unwound and passed through either the eyelet 34*a* or the islet 34*b* and the door or panel 34 is closed by means of the lock 38. Once outside the door or panel 34 each filament is guided substantially radially inwardly towards the machine axis $A_m$ by engagement with suitable guide elements or members, such as pigtail retaining elements 40, 42 and any additional number of guide elements as may be required. The filaments are then passed through the tensioning and sensing members 44, 46, as described, and to the closing station S (FIG. 2), where the filaments are introduced into the cable FC.

Referring primarily to FIGS. 3 and 4, it will be noted that once the door or panel 34 is closed, the chamber is substantially closed, with the minor exception of the very small openings in the eyelets 34*a*, 34*b*. Therefore, substantially independently of the speed of rotation of the unit, the interiors of the chambers are virtually immune to air turbulence. Referring to FIG. 4, however, the filament F will continue to be subjected, during rotation, to both the force of gravity $F_g$, which is always directed downwardly, and a centrifugal force $F_c$, which is directed radially outwardly in relation to the machine axis $A_m$. Since the centrifugal force is a function of the mass of the rotating product, the radius from the axis of rotation as well as the square of the angular velocity, it will be clear that the centrifugal forces that act on the filament F will increase with increased rotational speeds of the machine. Thus, for example, at 500 rpm, at a radius of approximately 28.5 inches from the machine axis $A_m$, the centrifugal force acting the on filament F is approximately 206 times the weight of the filament. As the filament F is drawn by the cable at the closing point S, the tension in the filament causes the filament to be drawn or pullet off in a generally axial direction from the package 28*a*. Referring particularly to FIG. 4, it will be clear that when the filament F is unwound in a counterclockwise direction from the cylindrical package, as viewed in FIG. 4, the filament reaches point, approximating point M, where the centrifugal force $F_c$ acting on the filament F will cause the filament to fly off the package and be cast out against the inner surface of the cylindrical wall 20 of the chamber. This is illustrated both in FIGS. 3 and 4. Since the cop 28 does not rotate, the filament F will continue to be unwound from the package and twisted as it is pulled at the application point. For this reason, the inner surface of the cylindrical wall 20 should be fairly smooth so as not to impart undue or unnecessary friction on the filament F as it is cast off the package 28*a* and slides along the surface.

Clearly, the specific patch taken by the filament F within the chamber 18 will be a function of the specific nature of the filament, its stiffness, softness, etc. The unit described is useful for applying particularly very flimsy, lightweight and soft filaments that are readily influenced by air turbulence. In more critical instances, the eyelet 34*b* may be utilized, which serves to keep a longer length of the filament within the chamber 18 before it is removed from the chamber. It is clear that the portion of the filament F outside the chamber, once it passes through an eyelet in the door or panel 34, will be subjected to air turbulence as the structure rotates about the machine axis. Thus, by moving the eyelet through which the filament F passes closer to the machine axis, the less it will be influenced by air turbulence. To the extent that such filament is, however, influenced by air turbulence, suitable and a sufficient number of guides need be provided along the path outside of the chamber to ensure that the forces imparted on the filament by air turbulence are adequately compensated for and controlled.

While one filament contemplated by the present invention is 100% Kevlar 49 aramid yarn, this is but one example of the type of filaments or fibers that may be applied by the instant apparatus. Other suitable materials that can be suitably dispensed with the instant applicator will become evident to those skilled in the art. Clearly, the stiffer the material, the more tension that is needed and the tougher the material, the less that it may be subject to air turbulence. Beyond a certain threshold, the door or panel may no longer be required because the forces imparted by the air turbulence are relatively minor compared to the stiffness of the material. Also, while a single, thin strand may be more resistant to air turbulence, a bulkier fiber which consists of many strands that encompass a relatively large area, such as Kevlar strands, may result in higher air friction.

At very low rotational speeds, a pivotally mounted arm for carrying or supporting the equivalent of an eyelet 34*a* may be used. This would leave, however, most of the downstream axial end of the chamber substantially open. Such an arm has been found to be workable up to approximately 150 rpm in dispensing Kevlar filaments. However, at 500 rpm, where significant forces are applied to the filaments, the panel or door 34 must be used to substantially seal the chambers so that the apparatus may be rotated at much higher speeds.

By use of the doors or panels 34, it has been found that these applicators can rotate up to 500 rpm, or at a speed 3½ times faster than could be achieved with an open arm eyelet support.

Although the present invention has been described in relation to particular embodiments thereof, many other variations, modifications and other uses will become apparent to those skilled in the art. It is the intention, therefore, that the present invention not be limited by the specific disclosure of the embodiments therein, but only by the scope of the appended claims. Thus, for example, although the doors or panels have been shown on the downstream axial ends of the chambers 18, these can also be placed on the opposite, downstream ends, with suitable modifications in the filament guides.

What I claim is:

1. A filament applicator for applying a plurality of filaments about a continuous elongate element at an application station; comprising a frame defining a machine axis at said application station; first guide means for guiding the elongate element along said machine axis at the application station; a plurality of chambers, each defining a chamber axis substantially parallel to said machine axis and mounted on said frame for rotation about said machine axis, each chamber being substantially closed and having a panel at an axial end of said chamber movable between an open position for inserting or removing a wound package of filament material from within the chamber and a closed position for substantially sealing said chamber and preventing air turbulence within said chamber upon rotation about said machine axis; each of said panels having an opening therein through which a filament can be removed from the wound package; and second guide means for guiding each filament from an associated opening to said machine axis for winding about or introduction into the elongate element, whereby removal of a filament from its associated wound package within a chamber is not influenced by air turbulence as said chambers containing the wound packages of filaments rotate about the machine axis.

2. A filament applicator as defined in claim 1, wherein said first guide means comprises a through hole or channel in said frame generally coextensive with said machine axis.

3. A filament applicator as defined in claim 1, wherein a mounting plate is mounted for rotation on said frame about said machine axis, and said chambers are fixedly secured to said mounting plate for rotation therewith.

4. A filament applicator as defined in claim 3, wherein said mounting plate is substantially circular and said chambers are mounted along the periphery of said mounting plate.

5. A filament applicator as defined in claim 4, wherein a predetermined number of chambers are provided that are dimensioned so that circumferentially adjacent chambers substantially abut against each other.

6. A filament applicator as defined in claim 5, wherein twelve chambers are provided, each of which occupies approximately 30° of the circumferential arc of said mounting plate.

7. A filament applicator as defined in claim 1, wherein each panel is movably attached to the radially innermost portion of an associated chamber, whereby centrifugal forces acting on said panels during rotation cause said panels to be urged against said chambers to ensure closure.

8. A filament applicator as defined in claim 7, wherein said panels are hingedly connected to said chambers.

9. A filament applicator as defined in claim 1, wherein each opening on an associated panel is arranged substantially coextensively along an associated chamber axis.

10. A filament applicator as defined in claim 1, wherein an additional opening is provided on each panel between said first mentioned opening and said machine axis.

11. A filament applicator as defined in claim 10, wherein each chamber has a right circular cylindrical configuration and each additional opening is spaced from an associated first-mentioned opening a distance less than one half of the radius of said chambers.

12. A filament applicator as defined in claim 1, further comprising latching means for securing each of said panels to associated chambers both when said chambers rotate and do not rotate about said machine axis.

13. A filament applicator as defined in claim 1, wherein said second guide means comprises retaining means for movably receiving a filament.

14. A filament applicator as defined in claim 13, wherein said retaining means comprises a plurality of spaced pigtail elements.

15. A filament applicator as defined in claim 1, further comprising tension means for controlling the tension of said filaments.

16. A filament applicator as defined in claim 15, further comprising tension sensing means for sensing the tensions in said filaments.

17. A filament applicator as defined in claim 1, wherein each chamber has a generally horizontal shaft extending from one axial end of said chamber and being substantially coextensive with said chamber axis of an associated chamber.

18. A filament applicator as defined in claim 17, wherein the axial length of said shaft is less than the axial length of an associated chamber.

19. A filament applicator as defined in claim 17, wherein the outer diameter of said shafts substantially corresponds to the inside diameter of a wound package of cop of filament material introduced into said chamber.

20. A filament applicator as defined in claim 1, further comprising locking means for locking wound packages or cops of filament materials introduced into said chambers to secure the same against movement.

21. A filament applicator as defined in claim 1, further comprising conforming means arranged to engage a cop of filament material introduced into a chamber for filling open spaces around at least a portion of said cop to prevent the filament from snagging machine parts or becoming twisted or knotted about itself.

* * * * *